US012233316B2

(12) United States Patent
Weinast

(10) Patent No.: US 12,233,316 B2
(45) Date of Patent: Feb. 25, 2025

(54) FOLD-UP TRAMPOLINE, METHOD FOR FOLDING UP A TRAMPOLINE AND METHOD FOR TENSIONING A JUMPING BED

(71) Applicant: Maike Weinast, Weinheim (DE)

(72) Inventor: Maike Weinast, Weinheim (DE)

( * ) Notice: Subject to any disclaimer, the term of this patent is extended or adjusted under 35 U.S.C. 154(b) by 185 days.

(21) Appl. No.: 17/787,407

(22) PCT Filed: Dec. 18, 2020

(86) PCT No.: PCT/EP2020/087094

§ 371 (c)(1),
(2) Date: Nov. 10, 2022

(87) PCT Pub. No.: WO2021/123218

PCT Pub. Date: Jun. 24, 2021

(65) Prior Publication Data

US 2023/0068254 A1 Mar. 2, 2023

(30) Foreign Application Priority Data

Dec. 20, 2019 (DE) ..... 102019135512.5
Feb. 12, 2020 (EP) ..... 20156977

(51) Int. Cl.
*A63B 5/11* (2006.01)
*A63B 21/04* (2006.01)

(52) U.S. Cl.
CPC ..... *A63B 5/11* (2013.01); *A63B 21/0428* (2013.01); *A63B 2210/50* (2013.01)

(58) Field of Classification Search
CPC ..... A63B 5/11
See application file for complete search history.

(56) References Cited

U.S. PATENT DOCUMENTS 6,110,074 A * 8/2000 Tacquet ..... A63B 5/11 482/28
6,648,799 B2 * 11/2003 Hall ..... A63B 5/11 482/28

(Continued)

FOREIGN PATENT DOCUMENTS

CN 203620152 U 6/2014
FR 2868957 A1 * 10/2005 ..... A63B 5/16

(Continued)

*Primary Examiner* — Nyca T Nguyen
(74) *Attorney, Agent, or Firm* — Hudak, Shunk & Farine Co. LPA

(57) ABSTRACT

A fold-up trampoline, having at least three posts arranged in parallel to one another and to a vertical direction (V), wherein a jumping bed is tensioned between the at least three posts, at least three bracing struts which connect a respective other pair of posts arranged next to one another in a peripheral direction (U) of the trampoline and stabilize these posts in a horizontal direction (H), wherein each bracing strut is foldably mounted on both posts arranged next to one another in the peripheral direction (U) and has at least one central joint, which is provided in a central region (B1) of the bracing strut, wherein all the posts arranged next to one another in the peripheral direction (U) can be moved towards one another in order to fold up the trampoline.

18 Claims, 7 Drawing Sheets

(56) References Cited

U.S. PATENT DOCUMENTS

| | | | | |
|---|---|---|---|---|
| 8,047,967 | B1 * | 11/2011 | Teng | A63B 5/11 482/28 |
| 9,889,363 | B1 * | 2/2018 | Myrick | A63B 21/0442 |
| 10,330,247 | B2 * | 6/2019 | Shimodaira | F16M 11/24 |
| D936,777 | S * | 11/2021 | Ren | D12/178 |
| 2005/0209053 | A1 * | 9/2005 | Knox | A63B 5/11 482/29 |
| 2010/0022355 | A1 * | 1/2010 | Goldwitz | A47B 23/044 482/27 |
| 2011/0021321 | A1 * | 1/2011 | Legg | A63B 5/11 482/29 |
| 2012/0248394 | A1 | 10/2012 | Thorne et al. | |
| 2016/0045775 | A1 * | 2/2016 | Zhou | A63B 5/11 482/27 |
| 2017/0093046 | A1 * | 3/2017 | Harvey | H01Q 1/288 |
| 2017/0239503 | A1 * | 8/2017 | Goldwitz | A63B 5/11 |
| 2018/0214728 | A1 * | 8/2018 | Ben Meir | E04H 4/0056 |
| 2019/0160318 | A1 * | 5/2019 | Grenåe | A63B 5/11 |

FOREIGN PATENT DOCUMENTS

| | | | | |
|---|---|---|---|---|
| GB | 2531166 | A * | 4/2016 | A63B 5/11 |
| KR | 101836036 | B1 * | 1/2017 | |
| KR | 101775308 | B1 | 9/2017 | |

* cited by examiner

FOLD-UP TRAMPOLINE, METHOD FOR FOLDING UP A TRAMPOLINE AND METHOD FOR TENSIONING A JUMPING BED

FIELD OF THE INVENTION

The invention relates to a foldable trampoline comprising at least three posts which are arranged parallel to one another and to a vertical direction, wherein a jumping bed is tensioned between the at least three parallel posts, at least three bracing struts, each connecting a different pair of posts adjacent in a circumferential direction of the trampoline and stabilizing said posts in a horizontal direction.

The invention further relates to a method for unfolding a foldable trampoline.

In addition, the invention relates to a method for tensioning a jumping bed of a foldable trampoline.

BACKGROUND OF THE INVENTION

US 2012/248394 A1 discloses a foldable cot.

KR 101 775 308 B1 discloses a frame with posts. Connecting struts which are pivotably mounted on the post are provided between the posts.

US 10 330 24 7 82 shows a foldable frame. The posts of the frame are pivoted toward one another for folding together.

A trampoline is already known from CN 103432710 8 which has six parallel posts, between which six bracing struts are provided. Two of the bracing struts have hinges. Furthermore, six securing rods are provided, of which two have hinges. CN 203 620 152 U discloses a corresponding trampoline.

SUMMARY OF THE INVENTION

The object of the invention is to design and arrange a foldable trampoline in such a way that it can be stowed in an as space-saving manner as possible and at the same time is as stable as possible during jumping activity.

The object is achieved according to the invention in that each bracing strut is mounted so as to be foldable on the two posts adjacent in the circumferential direction and has at least one central joint which is provided in a central region of the bracing strut, wherein all the posts adjacent in the circumferential direction for folding the trampoline are each movable toward one another in a horizontal direction. A bracing strut can be provided between each pair in the circumferential direction of adjacent posts.

The foldable trampoline can be folded and unfolded. In the folded state, its base area is greatly reduced. It thus takes up little space and can be stowed in a space-saving manner. When stowed in this manner, it can stand on the posts. In the unfolded state, the base area of the foldable trampoline is maximized. The base area is then at least as large as the area of the tensioned jumping bed. With the thus maximized jump region in the vertical direction above the jumping bed, the trampoline provides sufficient space for the jumping activity.

The trampoline has at least three parallel posts. It may also have four, five, six, seven, eight or more than eight posts. At least three posts are required to tension the jumping bed in one plane and to form the jump region. In the case of exactly three posts, the posts form the corners of a triangle in a plan view of the trampoline counter to the vertical direction. The more posts that are provided, the more corners of a geometric shape are formed by these posts in plan view, with the geometric shape then increasingly approximating a circle. A further advantage of a greater number of posts is that the more posts that are provided, the greater the stability of the trampoline is. The more posts are provided, the larger the diameter of the jumping bed can be. A larger jumping bed can have the advantage that it further increases bounce.

The posts may each have one, two or more than two wheels which allow the posts on the ground to be rollable in a horizontal direction H. The wheels can each have a parking brake which prevents a rotational movement.

The posts can have a base to which the wheels are attached. The base is axially wider than the further post so that there is space for at least two wheels. The pole can have a cross-sectionally V-shaped foot which can be attached to the post and in particular to the base. Both measures each lead to additional stability of the trampoline. The posts define a central axis of the trampoline. The central axis runs parallel to the posts and to the vertical direction. The central axis is located between the posts and has the same distance to each post in a horizontal direction. The circumferential direction extends around the central axis in a horizontal plane.

The jumping bed is itself elastic and/or elastically tensioned over an elastic element in such a way that it enables typical use of the trampoline. The bounce of a user on the trampoline can thus be reliably increased. Furthermore, the jumping bed is made of a stable material. Safe trampoline operation is thus ensured, in which the user does not have to fear the jumping bed tearing or being damaged during jumping, even in the case of continuous jumping.

The bracing struts each connect two posts adjacent in the circumferential direction. The bracing struts can be arranged parallel to a horizontal direction. Adjacent posts thus lie next to one another, as viewed in the circumferential direction, and the bracing struts extend in plan view counter to the vertical direction towards the trampoline at the edge of the trampoline and do not cross the area which forms the trampoline in this plan view. The bracing struts secure the trampoline in the horizontal direction so that the distance between two posts adjacent in the circumferential direction remains constant in the unfolded state of the trampoline. The distance between opposite posts remains constant as well. This gives the trampoline the necessary stability. The jumping bed can be attached partially or exclusively to the bracing struts. The bracing struts can also be rounded, such that they form a circular arc in each case in the plan view counter to the vertical direction and together form a circle.

At their ends, the bracing struts can be mounted so as to be foldable on the corresponding post by means of post joints. Hinges are suitable as post joints. In this respect, the bracing strut has a post joint at its first end or first end region and at its second end or second end region. The central region extends between the two ends or end regions. At least one central joint is provided in the central region of a bracing strut. Two, three or more than three central joints can also be provided in the central region. If the trampoline is folded, the foldable mounting of a bracing strut on the adjacent posts and the at least one central joint in the central region allow each bracing strut to be folded together.

If exactly one central joint is provided in the central region, this can separate the bracing strut into two sections of equal length. During folding, both sections fold toward the post. An internal angle between a section and a post is reduced in the process. In addition, the two sections fold toward one another. In this regard, an internal angle formed between the two sections is also reduced. The central joint can move in or counter to the vertical direction during folding.

Before folding, that is to say with the unfolded trampoline, all the posts are each parallel to one another and to the vertical direction V. During folding, the posts move in a horizontal direction. Thus, the distance between two posts lying next to one another in the circumferential direction is reduced in the process. This applies to all adjacent pairs of posts. In this regard, the posts move to a center, disposed between the posts, and the central axis. The movement of the posts during unfolding and/or folding can be a translational movement. The movement of the posts can be exclusively a translational movement. The distance between the individual posts is thus reduced accordingly during folding, in particular the distance between opposing posts is also reduced. After folding, that is to say in the case of the folded trampoline, the posts are parallel to one another and to the vertical direction V.

The trampoline can also be unfolded. If the trampoline is unfolded, the posts move away from one another in a horizontal direction. The movement which the posts make during folding is thus reversed during unfolding.

The post joints can have a degree of freedom, in particular precisely one degree of freedom. The central joint can have a degree of freedom, in particular precisely one degree of freedom. If the corresponding joint has exactly one degree of freedom, only a pivoting movement about a pivot axis is possible. A movement of the joint about a further pivot axis or a rotational movement is not possible. The pivot axes of the post joints on a connecting strut can each be perpendicular to this connecting strut. The pivot axis of the central joint on a connecting strut can be perpendicular to this connecting strut. The pivot axes of the post joints and of the central joint on a connecting strut can be parallel. If each post has a connecting strut with the corresponding joints, a purely translational movement of the posts during folding and unfolding is possible or necessary. The posts are then always parallel to one another during a folding and unfolding movement of the trampoline. The posts cannot move in a vertical direction V relative to one another during a folding movement. The posts can also not pivot relative to one another during a folding and unfolding movement of the trampoline.

The central joints of the bracing struts can be simple or double joint connectors.

The posts may be at least partially covered with a foam covering that protects the user from injury. The bracing struts can be at least partially or completely covered with a foam covering which protects the user from injuries.

In the unfolded state, a smallest angle β between a bracing strut and a post is 90°. In the folded state, a smallest angle β between a bracing strut and the post is less than 45°, 20°, 10° or 5°. It can also be 0°. The smaller the angle, the more compact the trampoline.

Furthermore, the object is achieved according to the invention in that the second Bowden cable system is operated and at least indirectly brings about a folding of the central joints of the bracing struts and/or of the central joints of the securing rods and/or of the poles, wherein all the posts adjacent in the circumferential direction move towards one another.

With the aid of this method, the folding can be carried out as simply as possible. The corresponding Bowden cable system can be actuated centrally by the user. It is also possible to provide a motor or a crank which operates the folding.

According to the invention, the object is achieved according to the invention in that the jumping bed is tensioned via the separate tensioning apparatus during or after the unfolding of the foldable trampoline.

The tensioning apparatus facilitates the tensioning of the jumping bed and enables a tensioning which is as strong as possible. The tensioning apparatus can be designed as a separate crank or the like. The crank can be operated during or after unfolding of the trampoline. The tensioning apparatus can also be a part of the second Bowden cable system which simultaneously drives the unfolding of the trampoline. Such a tensioning apparatus is dependent on the unfolding process of the trampoline.

It may also be advantageous for this purpose if a central joint and at least two poles are provided, wherein each pole connects a corresponding post to the central joint and is mounted so as to be foldable both on the corresponding post and on the central joint. A pole may be provided for each post. The central joint can be fastened exclusively to the poles.

The combination of central joint and poles described with this aspect gives the trampoline additional stability. In the unfolded state, the combination prevents relative movement of the posts, in particular in a horizontal direction. Particular stability arises if a pole is provided at least on three other posts.

The foldable mounting is achieved by means of edge joints on the central joint and the post. These joints can in particular be hinges. In this case, a joint securing means can be provided on the edge joint of the central joint and/or on the edge joint of the post, which prevents undesired folding or unfolding by preventing a joint movement.

The edge joints can have a degree of freedom, in particular precisely one degree of freedom. The pivot axes of the edge joints on a pole can each be perpendicular to this pole.

The central joint is disposed in a horizontal plane between the posts. The central joint can lie on the central axis. The poles can be parallel to the horizontal direction, then the poles and the central joint lie in the horizontal plane.

If the trampoline is folded, the poles with the corresponding post form a smallest angle γ of less than 5°, 10°, 20°, 30°, 40° or 50°. In particular, the poles can be positioned in the vertical direction. In other words, the poles can be folded upwards. If the trampoline is unfolded, the smallest angle γ is greater than 50°, 60°, 70° or 85° or is 90°.

On the central joint, a cover can be provided which has such a structure that in the folded state it protects the jumping bed from damage. This cover can be a section of an exercise ball.

Two or more than two central joints can also be provided, and the aforementioned then applies accordingly. The poles are then associated with the corresponding central joint.

Furthermore, it may be advantageous if the jumping bed is tensioned by means of at least one elastic element, wherein the elastic element is attached to at least one post and/or to at least one bracing strut.

The elastic element may be a single cable or a spring. If the elastic element is a spring, a plurality of elastic elements can be provided. The spring can be fastened between the jumping bed and the bracing strut or post by means of a carabiner, in particular a triangular carabiner. The carabiner can have a screw closure for closing the carabiner. By using at least one elastic element, the increase in bounce can be additionally improved. In addition, the material for the jumping bed can also be chosen more freely, since the jumping bed does not solely have to provide the elasticity for the increase in bounce.

According to a further aspect, in order to cover the at least one elastic element and thus reduce the risk of injury, a protective cover can be provided. Furthermore, retaining means can be provided on the bracing struts and/or the jumping bed and retaining elements can be provided on the cover, which form the counterparts to the retaining means, wherein the cover can be releasably fixed to the bracing struts and/or to the jumping bed via the retaining elements and the retaining means. The retaining means can be designed as buttons and/or button holes. The retaining elements can be designed as buttons and/or button holes. The retaining means and elements can also together form a push button. The cover may be attached to a safety net. By detaching the protective cover, the trampoline can be folded together more compactly.

It may also be advantageous if the central joint and the tensioned jumping bed have a shortest distance a in the vertical direction, where a>=20, 30, 40 or 50 cm.

Since during jumping activity the jumping bed is deflected in or counter to the vertical direction, it is advantageous to select the shortest distance a to be sufficiently large so that as large a deflection as possible in or counter to the vertical direction is possible without the jumping bed touching the central joint or the poles.

The shortest distance a in the vertical direction is the smallest distance which exists in the vertical direction between the jumping bed and the central joint. The shortest distance a is thus the minimum possible distance between the jumping bed and the central joint in this direction.

The shortest distance a is defined when the jumping bed is tensioned. It is thus defined when the trampoline is completely unfolded. Furthermore, it is to be defined when the jumping bed is not deflected in or counter to the vertical direction by the jumping activity of the user.

In this case, at least three securing rods can advantageously be provided, which each connect another pair of adjacent posts to one another and stabilize the posts in a horizontal direction, wherein each securing rod is mounted so as to be foldable on the corresponding post and has at least one central joint which is provided in a central region of the securing rod and is used for folding the trampoline. A securing rod can be provided between each pair of posts adjacent in the circumferential direction. The securing rods can also be rounded, such that they form a circular arc in each case in the plan view counter to the vertical direction and together form a circle.

The securing rods additionally stiffen the trampoline and give it additional stability. The securing rods may be covered with a foam covering which protects the user from injury. A safety net can be tensioned between the securing rods and the bracing struts, which prevents the user from unintentionally jumping out of the jump region above the jumping bed. The safety net is not necessary for the function of the trampoline.

The post joints can have a degree of freedom, in particular precisely one degree of freedom. The central joint can have a degree of freedom, in particular precisely one degree of freedom. The pivot axes of the post joints on a securing rod can each be perpendicular to said securing rod. The pivot axis of the central joint on a securing rod can be perpendicular to said securing rod. The pivot axes of the post joints and the central joint on a securing rod can be parallel.

The central joints of the securing rods can be pipe joints, bimini joints or pipe folding joints. The securing rods can be made of fiberglass.

It may also be advantageous if the at least three posts have an upper section and a lower section, wherein the upper section is arranged in the vertical direction V above the lower section, wherein a section joint is provided via which the upper section can be pivoted relative to the lower section. Each post may have a corresponding upper section, lower section and a section joint.

In the case of the unfolded trampoline, the upper section and the lower section are coaxial. A smallest angle $\alpha$ between the upper section and lower section is 180°. The section joint is then unfolded. In the case of the folded trampoline, the upper section and the lower section form a smallest angle $\alpha$ of less than 180° and are not coaxial. The system can be designed in such a way that a smallest angle $\alpha$ of less than 45°, 20°, 10° or 5° is possible. The smallest angle can be particularly preferably 0°. The section joint is then folded. In the case of the folded trampoline, the height with respect to the unfolded trampoline is thus reduced and the trampoline requires less space when stowed.

The securing rods can be mounted on the upper section. The bracing struts can be mounted on the central section. The base can be provided counter to the vertical direction V below the lower section.

It can be of particular importance for the present invention if a jump region for the user is provided in the vertical direction above the jumping bed, wherein the central joint is provided below the jumping bed counter to the vertical direction and/or the securing rods are provided above the jumping bed in the vertical direction.

The arrangement described with this aspect provides additional stability of the trampoline and the attachment of the safety net.

In connection with the design and arrangement according to the invention, it may be advantageous if a separate tensioning apparatus is provided for tensioning the jumping bed, wherein the tensioning apparatus acts in a manner independent of and/or dependent on the unfolding of the trampoline.

The tensioning apparatus facilitates the unfolding of the trampoline and tensioning of the jumping bed and enables particularly strong tensioning.

A tensioning apparatus is dependent on the unfolding if the tensioning apparatus has to act during unfolding. In this regard, the tensioning apparatus can interact with a first Bowden cable system, which can also drive the unfolding of the trampoline.

A tensioning apparatus is independent of the unfolding if it does not have to act during unfolding and can also be operated after unfolding. The tensioning apparatus can be designed as a separate crank or the like. The crank can be operated during or after unfolding of the trampoline.

A securing tensioning cable can be provided, which is connected to the tensioning apparatus, and which is guided in particular by the bracing struts and/or securing rods. The securing tensioning cable can be designed as a steel cable. As a result of the tensioning of the securing tensioning cable by means of the tensioning apparatus, the bracing struts and/or securing rods are unfolded and thereby tension the jumping bed. At the same time, the tensioning apparatus secures the joints.

It may also be advantageous if joint securing means are provided on the central joints of the bracing struts and/or the securing rods for fixing the central joints. Joint securing means can also be provided on the post joints, the section joints and/or the edge joints. The joint securing means on a corresponding bracing strut can be designed as a foot which, in the unfolded state of the trampoline, stands on a surface and thus prevents a pivoting movement on the surface. During a folding movement, the foot moves in a vertical direction V.

The joints can be fixed in the case of the unfolded trampoline. The fixing then gives additional stability to the trampoline. In particular during jumping activity, the joints are prevented from unintentionally folding and a relative movement between the posts is prevented from occurring due to the forces additionally acting on the jumping bed. The joints can be fixed when the trampoline is folded so that the trampoline is prevented from unintentionally unfolding.

Finally, it may be advantageous if a tensioner, in particular designed as a motor or a crank, is provided for operating at least part of the folding movement and/or the unfolding movement. The crank can be a winch.

The corresponding movement can be facilitated by using a tensioner. The implementation of the folding and/or unfolding movement can be automated by using a motor. In this case, the motor can be provided on the central joint. In order to bring about the corresponding movement, the motor can be connected to a first Bowden cable system and/or a second Bowden cable system, which can drive the folding of the trampoline.

In addition, it may be advantageous if a first Bowden cable system is provided, by means of which the unfolding of the trampoline can be operated, and/or a second Bowden cable system is provided, by means of which the folding of the trampoline can be operated.

In this way, the folding or unfolding can be carried out as simply as possible. The corresponding Bowden cable system can be actuated centrally by the user. The corresponding Bowden cable system can be designed as a steel cable. A tensioner for the corresponding Bowden cable system can be provided, which operates the folding and/or unfolding and is connected to the corresponding Bowden cable system. The tensioner may be designed as a motor.

Furthermore, it may be advantageous if the first Bowden cable system and/or the second Bowden cable system are at least partially guided within a post and/or a pole and/or a securing rod.

In this way, a large part of the first and/or second Bowden cable system can be concealed within the post and/or the pole and/or the securing rod and be shielded from the user. This is advantageous for the safety of the user, since it reduces the possibility of being drawn into the Bowden cable system and thereby being injured.

It may be advantageous if at least one guide element is movably mounted in a bearing device within a post and/or a pole and/or a securing rod, wherein the first Bowden cable system and/or the second Bowden cable system are guided via the guide element or are fixed to the guide element.

Owing to the deflection of the guide element, a larger section of the second Bowden cable can be mounted inside the post and/or the pole and/or the securing rod when the trampoline is unfolded, which additionally increases the safety of the user. If the trampoline is unfolded, the second Bowden cable system is under tension. Thus, it deflects the guide system in the bearing device in that the guide system moves from the rest position against the force of the restoring element. The same applies to the second Bowden cable system in the case of a folded Bowden cable system.

Since, when the guide element is deflected, radial forces can occur which act on the guide element, an increase in the post width can be provided at least in the region of the bearing device. In this case, the post can have an oval cross section.

In addition, a restoring element can be provided which pulls the guide element into a rest position, and the application of a force to the Bowden cable system deflects the guide element out of the rest position.

In addition, it may be advantageous if the first Bowden cable system has an angled pole between a post and a bracing strut or pole and/or a securing rod, which angled pole, during unfolding of the trampoline, exerts a force in such a way that the bracing strut and/or the pole and/or the securing rod moves toward the position in the unfolded state. In this way, the first Bowden cable system brings about at least partial or complete unfolding of the trampoline. The first Bowden cable system can have an angled pole on at least one bracing strut, two bracing struts or each bracing strut.

The following designs concerning the angled pole relate to its arrangement on the bracing strut. However, the designs apply accordingly when the angled pole is arranged on a pole or a securing rod.

The angled pole can be mounted on a bracing strut via a guide joint and can be mounted on a post via an outer joint. The guide joint and/or the outer joint can have a degree of freedom, in particular precisely one degree of freedom. The pivot axis of the guide joint on an angled pole can be perpendicular to this angled pole. The pivot axis of the outer joint on an angled pole can be perpendicular to this angled pole. The pivot axes of the outer joint and of the guide joint can be parallel.

The guide joint can be guided in a guide. The first Bowden cable system can have a Bowden cable via which the guide joint can be moved in the guide, wherein the movement of the guide joint within the guide is what causes the force that causes the unfolding movement. The Bowden cable can be deflected via a deflection element in such a way that the pull direction on the guide joint corresponds to the direction in which the guide joint is movable in the guide.

In addition, a securing system can be provided on the first Bowden cable system, which prevents pivoting of the bracing strut in the unfolded state. The securing system can be designed as a bolt, pin or latching system. The securing system thus stabilizes the trampoline during jumping activity. This gives the trampoline stability.

Furthermore, it can be advantageous if trampoline can be unfolded and/or folded via an exclusively translational movement of each post towards a central axis of the trampoline in each case. This translational movement of the posts directed towards the center of the trampoline can be easily carried out because the posts do not need to be folded or pivoted. They are always oriented parallel to one another. Folding or unfolding is therefore simple in particular for large trampolines. A post is mechanically guided in such a way via the connecting struts, poles and/or securing rods articulated on it that pivoting of the post relative to the other posts is precluded, and consequently the posts are moved parallel to one another. The posts are each movable in a horizontal direction H during the corresponding folding movement of the trampoline. During the folding movement of the trampoline, the bracing struts can fold together via the at least one central joint, wherein the central joint can be moved in a vertical direction V. The central joint can be moved at right angles to the posts during the corresponding folding movement of the trampoline. The central joint moves translationally in the process.

A translational movement is a translation. Translation is a movement in which all points of a rigid body undergo the same displacement.

Furthermore, it may be advantageous if the second Bowden cable system is operated and at least indirectly causes the upper section and the lower section of the posts of the unfolded trampoline to be pivoted from a coaxial position into a position in which they form a smallest angle α of less than 180°, 90°, 45°, 20°, 10° or 5°. The smallest angle α can be particularly preferably 0°.

As a result of the folding of the sections, the trampoline becomes smaller.

BRIEF DESCRIPTION OF THE DRAWINGS

Further advantages and details of the invention are explained in the claims and in the description and illustrated in the drawings. Therein:

DETAILED DESCRIPTION OF THE INVENTION

Figure 1:
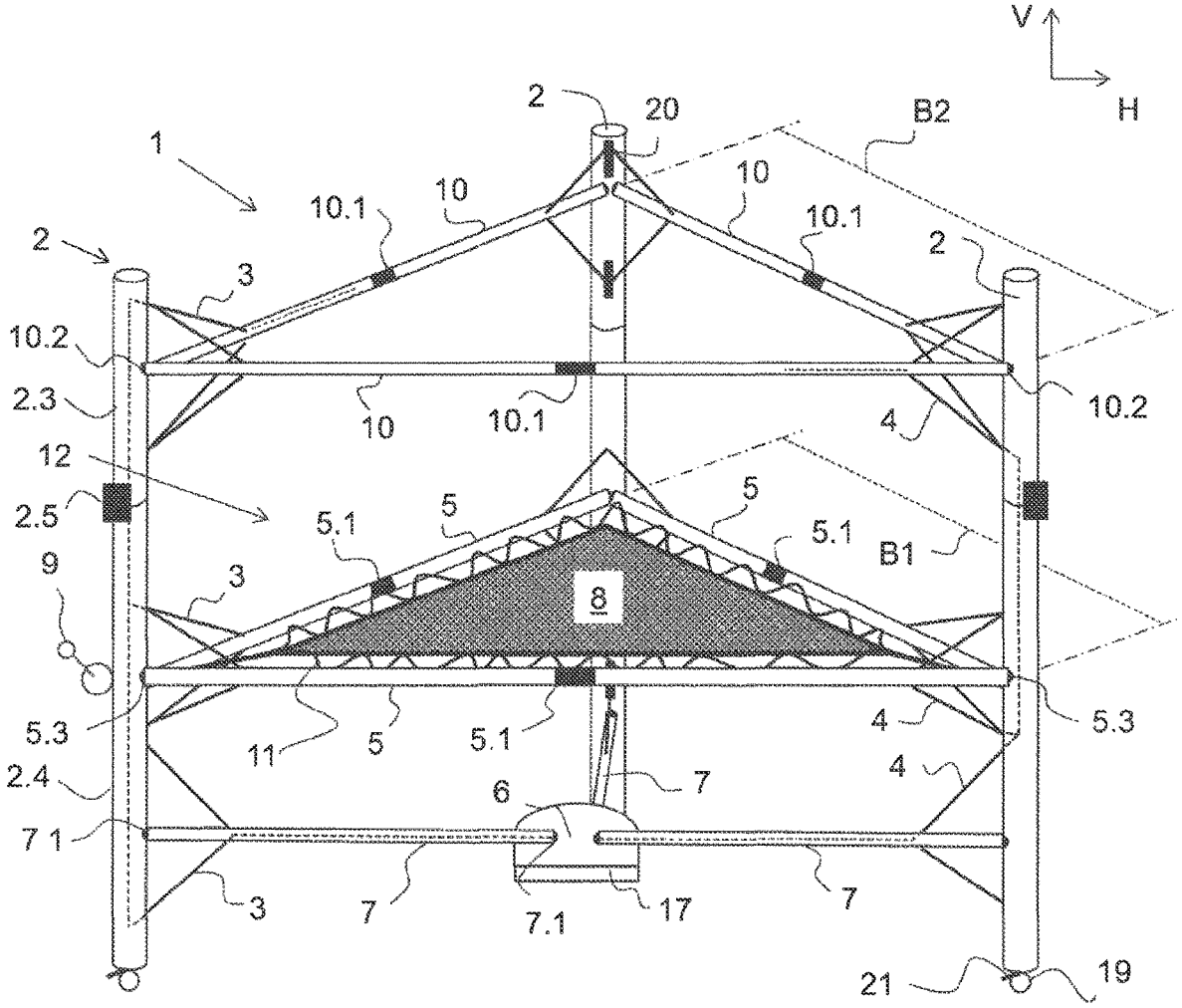
FIG. 1 shows a perspective view of a foldable trampoline.

A foldable trampoline 1 has three posts 2 in FIG. 1. The posts 2 are parallel to one another and to a vertical direction V. Each post 2 has an upper section 2.3 and a lower section 2.4, which are each connected to one another in a foldable manner via section joints 2.5. The posts 2 each have a wheel 19 which allows the posts to be movable in a horizontal direction H. The wheels 19 have a parking brake 21.

Furthermore, three poles 7 are provided, which each connect one of the posts 2 to a central joint 6. The poles 7 are each fastened to the posts 2 and the central joint 6 in a foldable manner. In this context, edge joints 7.1 are provided which allow the flaps to be folded. The edge joints 7.1 can be designed as hinges. Each of the poles has two of the edge joints 7.1 at their ends.

Three bracing struts 5 are provided in the vertical direction V above the poles 7. The bracing struts 5 extend in a horizontal direction H. Each of the bracing struts 5 has a central joint 5.1 in its central region B1. A post joint 5.3 is provided in the form of a hinge at the two edges of a bracing strut 5, whereby the bracing strut 5 is mounted so as to be foldable on the post 2. The post joints 5.3 do not lie in the central region B1.

A jumping bed 8 is tensioned in a horizontal plane between the bracing struts 5. An elastic element 11, which is designed as a cable, is fastened to the jumping bed 8 and the bracing struts 5 and tensions the jumping bed 8. In addition, a tensioning apparatus 9 is provided, which is designed here as a crank and via which the elastic element 11 can additionally be tightened. A jump region 12 for the user is located in the vertical direction above the jumping bed 8 and between the posts 2.

Above the bracing struts 5 in the vertical direction V, securing rods 10 are provided, each of which has a joint 10.1 in a central region 82. The securing rods 10 are fastened to the posts 2 so as to be foldable, wherein post joints 10.2 are provided on the two edges of a securing rod 10. The post joints 10.2 do not lie in the central region B2.

A tensioner 17 is provided in the form of a motor on the central joint 6. The tensioner 17 operates a first Bowden cable system 3 and a second Bowden cable system 4. The unfolding of the trampoline 1 is brought about with the aid of the first Bowden cable system 3. The second Bowden cable system 4 brings about the folding of the trampoline 1. A part of the first Bowden cable system 3 and of the second Bowden cable system 4 extends outside the post 2 and the poles 7 so as to be visible in the surroundings. Slots 20 in the posts 2 make it possible for a part of the first Bowden cable system 3 and of the second Bowden cable system 4 to run within the posts 2, the poles 7 and the securing rods 10. The course of the one part of the first Bowden cable system 3 and of the second Bowden cable system 4 within the posts 2 is illustrated by way of example with the aid of the dashed line. The first Bowden cable system 3 and the second Bowden cable system 4 run per se next to one another and independently of one another through the posts 2 and the poles 7.

Figure 2:
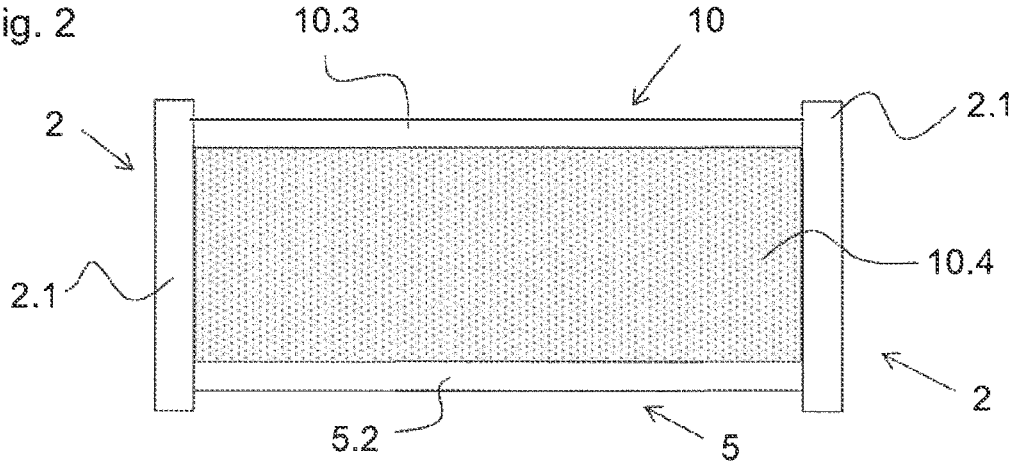
FIG. 2 shows a front view of two adjacent posts with a safety net.

The adjacent posts 2 in FIG. 2 have a foam covering 2.1. Likewise, the securing rod 10 has a foam covering 10.3 and the bracing strut 5 has a foam covering 5.2. A safety net 10.4 is tensioned between the bracing strut 5 and the securing rod 10. The foam coverings 5.2, 10.3 and the safety net 10.4 are used for the safety of the user.

Figure 3:
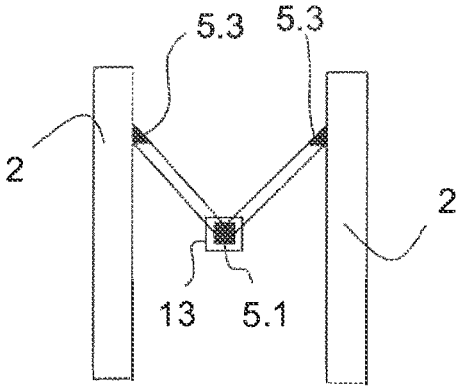
FIG. 3 shows a front view of a bracing strut with a joint.

In FIG. 3, the post joints 5.3 of a bracing strut 5 are fastened directly to the adjacent posts 2 and a central joint 5.1 is provided. A joint securing means 13 via which the angle of the central joint 5.1 can be fixed is disposed on the central joint 5.1.

Figure 4:
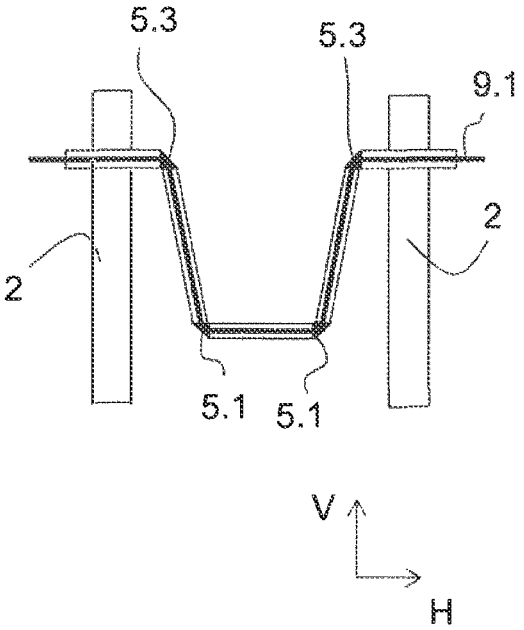
FIG. 4 shows a front view of a bracing strut with two joints.

In FIG. 4, the post joints 5.3 are not provided directly on the adjacent posts 2, but offset in or counter to a horizontal direction H. In addition, two central joints 5.1 are provided.

A securing tensioning cable 9.1 is guided through the bracing struts 5. The securing tensioning cable 9.1 can be tensioned by means of the tensioning apparatus 9, whereby the jumping bed 8 can be tensioned. The securing tensioning cable 9.1 can also fix the joints.

The bracing strut in each of FIGS. 3 and 4 is not unfolded because it is angled downward counter to the vertical direction V.

Figure 5A:
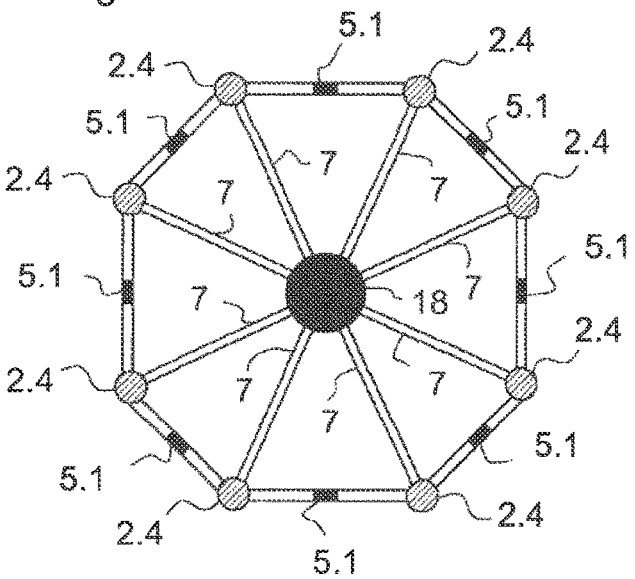
FIG. 5*a* shows a plan view of the trampoline in the unfolded state.
Figure 5B:
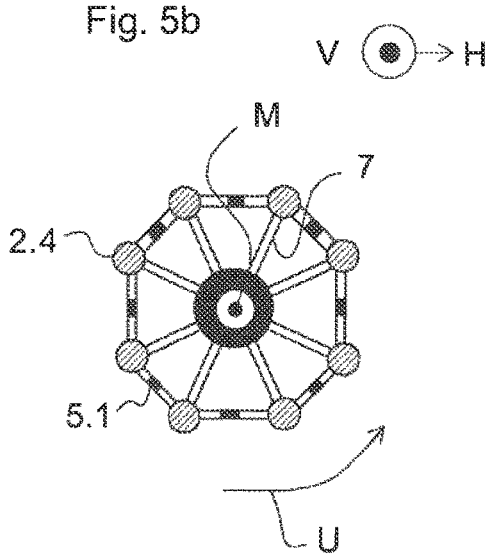
FIG. 5*b* shows a plan view of the trampoline in the folded state.

FIGS. 5*a* and 5*b* show a plan view of a trampoline 1 with eight posts 2, of which only the lower section 2.4 is shown, wherein in particular the post joints 5.3, 10.2 are not shown so as to provide a clearer representation. The central joints 5.1 of the bracing struts 5 and the securing rods 10 can be seen in the representations. The central joint 6 is concealed counter to the vertical direction V below a cladding 18 and is thus not visible. FIG. 5*b* also shows the central axis M of the trampoline 1. The central axis M is parallel to the vertical direction V. A circumferential direction U runs in a horizontal plane about the central axis M.

FIG. 5*a* shows the trampoline 1 unfolded. FIG. 5*b* shows the trampoline 1 folded. The distance in the circumferential direction U of adjacent posts of a folded trampoline is significantly less than the distance in the circumferential direction U of adjacent posts of an unfolded trampoline. During folding, the posts thus move toward one another and in each case move radially onto the central axis M in a horizontal direction H. During unfolding, the movement is reversed accordingly.

Figure 6A:
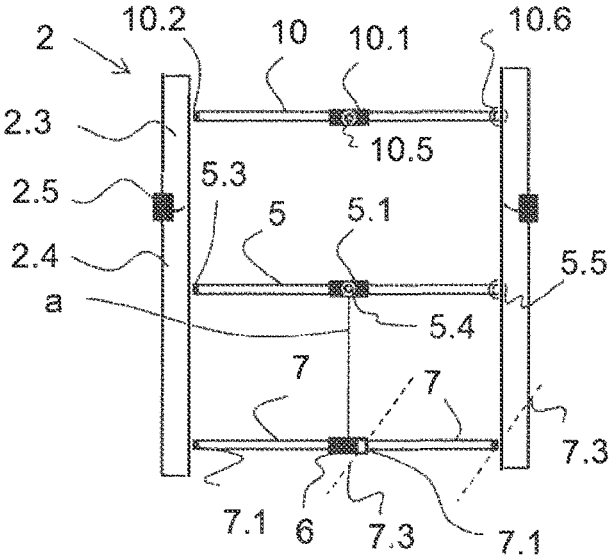
FIG. 6*a* shows a front view of two posts of an unfolded trampoline.
Figure 6B:
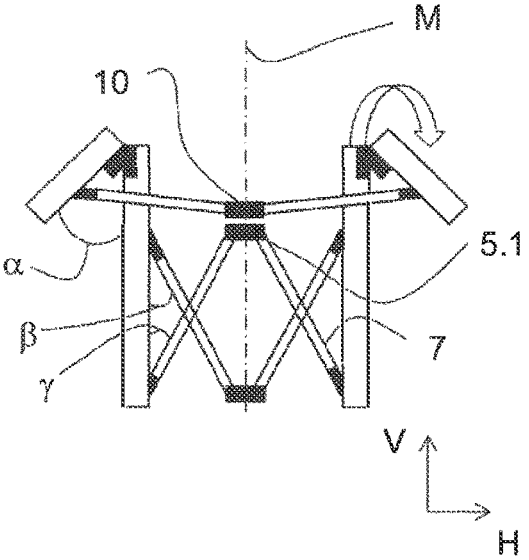
FIG. 6*b* shows a front view of two posts of a folded trampoline.

FIGS. 6*a* and 6*b* show a detail of the trampoline 1 with two posts 2 in a front view. FIG. 6*a* also shows the smallest distance a in the vertical direction V between the central joint 5.1 and the central joint 6.

In FIG. 6*a* the trampoline 1 is unfolded, and the trampoline 1 in FIG. 6*b* is folded. The edge joints 7.1, with which the poles 7 are mounted so as to be foldable on the adjacent posts 2 and the central joint 6, allow the poles 7 to fold upwards in the vertical direction V during folding, with the adjacent posts 2 moving towards one another. Accordingly, the post joints 10.2 of the securing rod 10 and the post joints 5.3 of the bracing strut 5 make it possible for these to fold away downwards in each case counter to the vertical direction V. During unfolding, the movement is reversed accordingly.

In the unfolded trampoline 1, the section joint 2.5 is unfolded and the upper section 2.3 and the lower section 2.4 of the post 2 are coaxial. If the trampoline 1 is folded in, the upper section 2.3 and the lower section 2.4 are angled with respect to one another and form a smallest angle $\alpha$ of 45°. However, it is also possible for the angle $\alpha$ to be smaller in order to fold the trampoline as compactly as possible. The trampoline is reduced in height. The unfolding movement proceeds as indicated by the arrow in a horizontal direction H radially away from the central axis, which in FIG. 6*b* lies behind the posts 2 in the plane of the image, such that the securing rods 10 are guided in the plane of the image in front of the posts 2.

A smallest angle $\beta$ between a bracing strut and the post is about 30°. However, it can also be smaller; the smaller the angle, the more compact the trampoline. A smallest angle $\gamma$ between a pole and the post is also about 30°. This angle can also be smaller.

The movement of the posts 2 during folding or unfolding is a translational movement. The posts 2 move toward one another or away from each other in a horizontal direction H. The posts 2 do not move in a vertical direction V. During this movement, the posts 2 always remain parallel. This movement is made possible by the pivot axis 5.4 of the central joint 5.1 as well as the pivot axes 5.5 of the edge joints 5.3. These pivot axes 5.4, 5.5 of a connecting strut 5 are each parallel to one another and orthogonal to the connecting strut 5. The same applies to the pivot axis 10.5 of the central joint 10.1 and the pivot axis 10.6 of the post joint 10.2. Each pole 7 has two edge joints 7.1, wherein an edge joint 7.1 is provided between the pole 7 and the post 2 and an edge joint 7.1 is provided between the pole 7 and the central joint 6. The pivot axes 7.3 of the edge joints 7.1 are each orthogonal to the pole 7 and parallel to one another.

Figure 7:
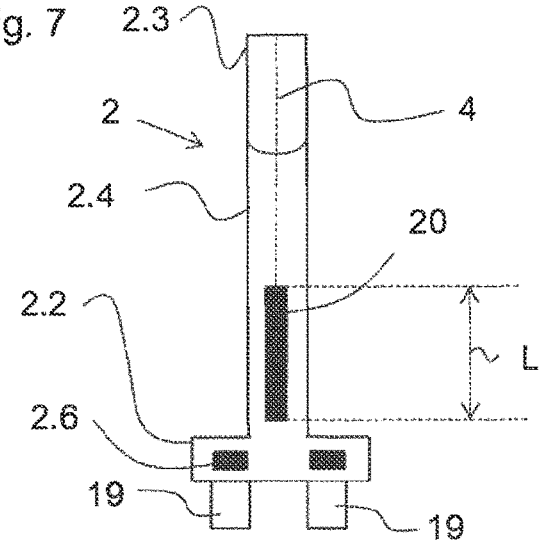
FIG. 7 shows an embodiment of a post with two wheels.
Figure 8:
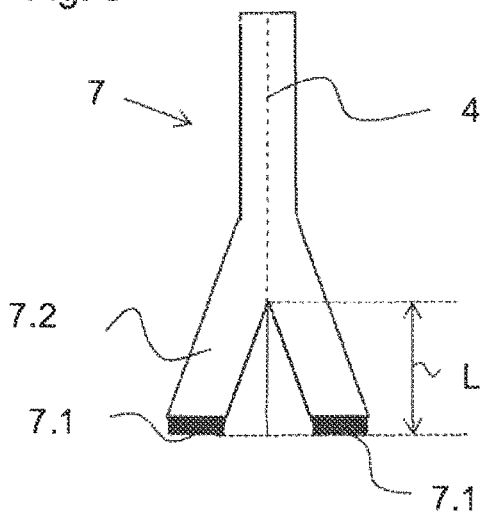
FIG. 8 shows an embodiment of a pole with V-shaped foot.

In FIG. 7, the post has a base 2.2. The base 2.2 is axially wider than the upper section 2.3 and the lower section 2.4 of the post 2 so that there is space for two wheels 19. The base 2.2 has two contact regions 2.6 for edge joints 7.1. In FIG. 8, the pole 7 can have a V-shaped foot 7.2. Two edge joints 7.1 are provided at the two ends of the V-shaped foot 7.2. Between the legs of the V-shaped foot 7.2, the second Bowden cable system 4 is exposed over a length L until it is received again in the post 2 via the slot 20 shown in FIG. 7, which also has the length L in the axial direction. Both measures each lead to additional stability of the trampoline 1, in particular if all the posts 2 of a trampoline 1 have the base 2.2 and each pole 7 has a V-shaped foot 7.2.

Figure 9A:
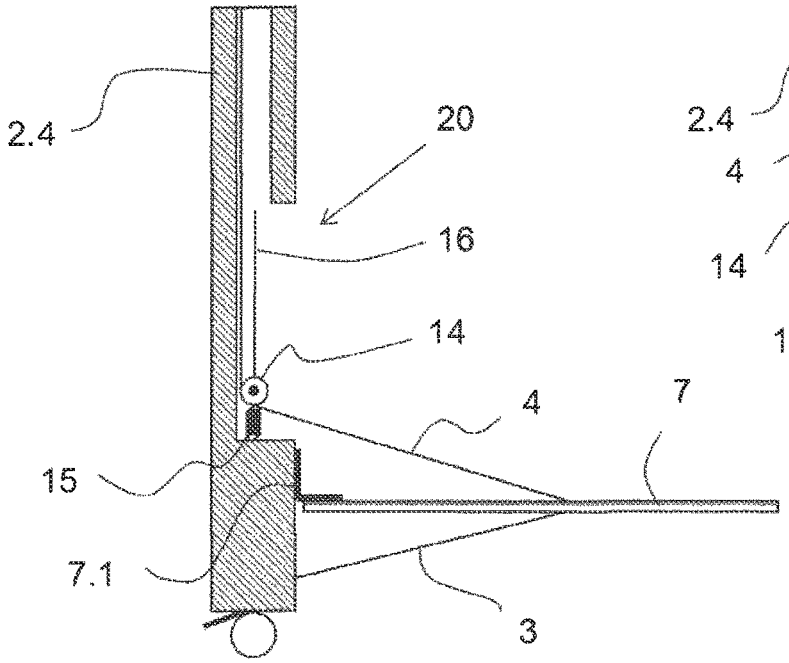
FIG. 9*a* shows a section through a post with a movably mounted guide element of an unfolded trampoline.
Figure 9B:
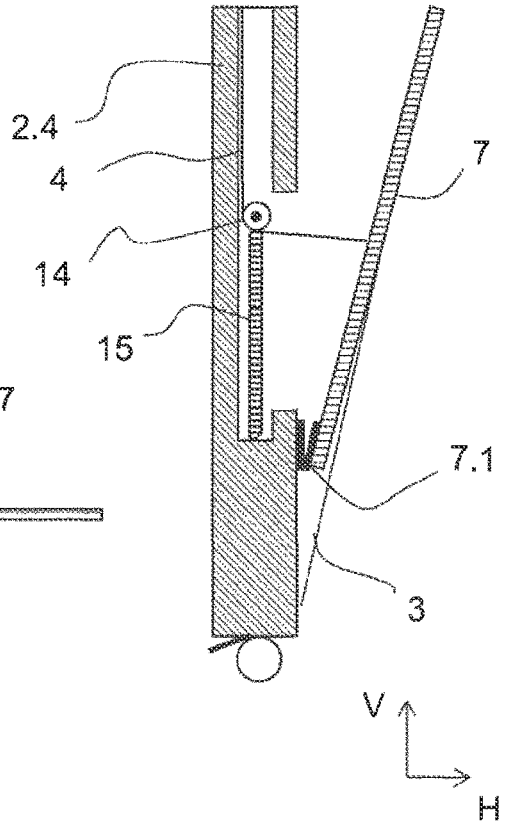
FIG. 9*b* shows a section through a post with a movably mounted guide element of a folded trampoline.

FIGS. 9*a* and 9*b* show a section through a post 2 having a slot 20. The post 2 is partially hollow. A guide element 14, designed as a roller, is provided within the post 2, via which guide element a part of the second Bowden cable system 4 is guided. The guide element 14 is mounted in a bearing device 16. In addition, a restoring element 15, designed as a spring, is provided, which pulls the guide element 15 into a rest position. An edge joint 7.1, in the form of a hinge, of the pole 7 is fastened to the post 2. A part of the first Bowden cable system 3 is also shown.

FIG. 9*a* shows the unfolded trampoline 1 and FIG. 9*b* shows the folded trampoline 1. In the case of the unfolded trampoline 1, the guide element 14 is in the rest position, into which it is driven by the restoring element 15. There is no tension on the second Bowden cable system 4. During folding, tension is applied to the second Bowden cable system 4, the guide element 14 is moved out of the rest position along the bearing device 16 and the restoring element 15 is tensioned. Due to the movement of the guide element 14 along the bearing device 16, the second Bowden cable system 4 is deflected further upward in the vertical direction V and the exposed part of the second Bowden cable system 4 is reduced. When tension is taken from the second Bowden cable system for unfolding, the restoring element 15 causes the guide element 14 to move back into the rest position. The exposed part of the Bowden cable system is thus also minimized for the unfolded trampoline 1.

Figure 10A:
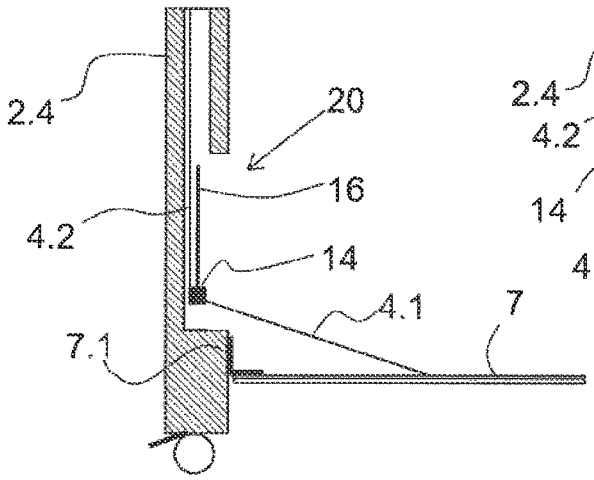
FIG. 10*a* shows a section through a post with an alternative embodiment of a guide element of an unfolded trampoline.

Another exemplary embodiment is shown in FIG. 10*a*. The post 2 is connected to a pole 7 via an edge joint 7.1. The edge joint 7.1, and thus the trampoline 1, is unfolded. The second Bowden cable 4 has a first Bowden cable section 4.1 and a second Bowden cable section 4.2. The first Bowden cable section 4.1 and the second Bowden cable section 4.2 are each fixedly connected to the guide element 14 designed as a piston and are each tensioned. Owing to the tension of the first Bowden cable section 4.1, the guide element 14 is pulled downward within the bearing device 16 counter to the vertical direction V and is in the lowermost position within the bearing device 16.

Figure 10B:
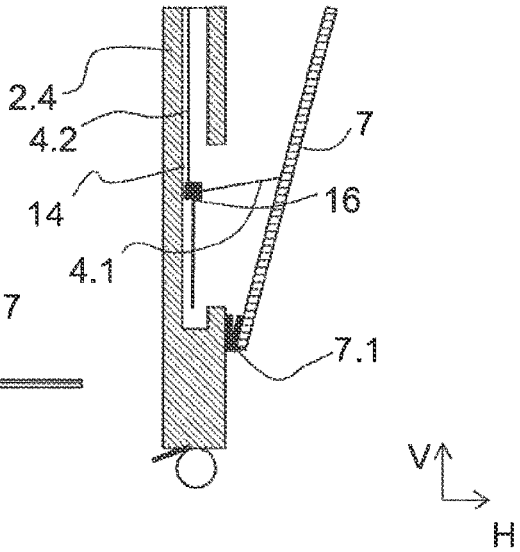
FIG. 10*b* shows a section through a post with an alternative embodiment of a folded trampoline.

In FIG. 10*b*, the edge joint 7.1 and thus the trampoline 1 are folded. The first Bowden cable section 4.1 has been shortened to operate the folding. Owing to this shortening, the guide element 14 has been pulled upward in the vertical direction V and is in the uppermost position in the guide element 16.

Figure 10C:
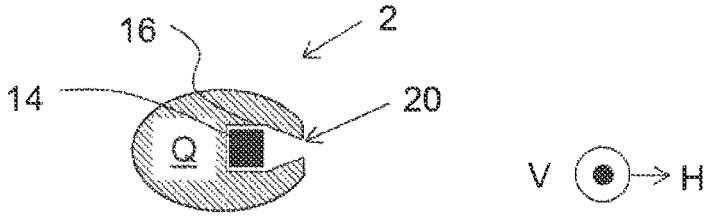
FIG. 10*c* shows a cross section of a reinforced post in the region of a slot.

In FIG. 10*c*, the post 2 has an oval cross section Q, thus an axial increase in the post width in the region of the slot 20. The bearing device 16 is formed by the post itself, such that the guide element 14 is guided in the interior of the post 2 from the post walls.

Figure 11A:
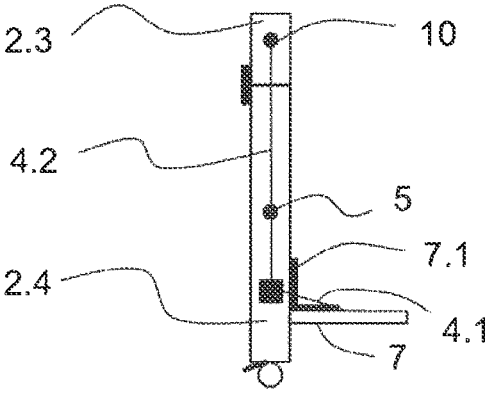
FIG. 11*a* shows a front view of a post with an alternative embodiment of an unfolded trampoline.
Figure 11B:
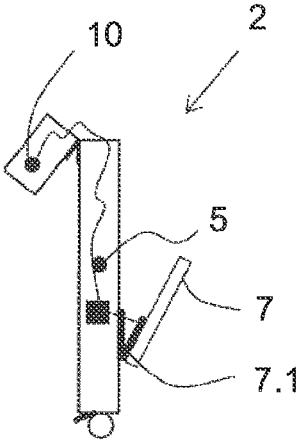
FIG. 11*b* shows a front view of a post with an alternative embodiment of a folded trampoline.
Figure 12:
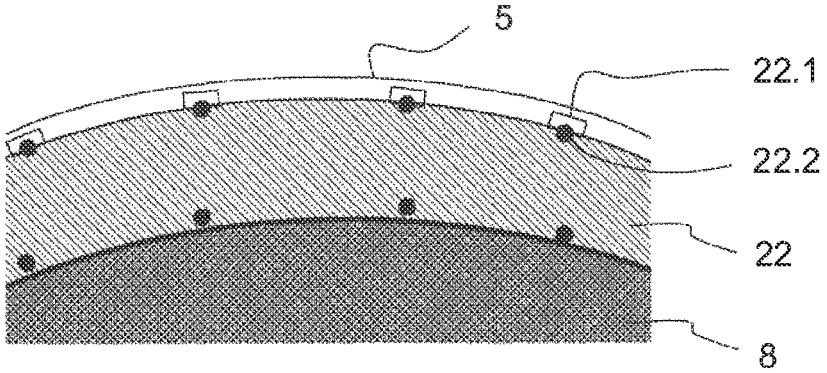
FIG. 12 shows a plan view of a protective cover.

A further aspect of this embodiment is shown in FIGS. 11*a* and 11*b*. As before, the post 2 has the upper section 2.3 and the lower section 2.4. The two sections 2.3, 2.4 are connected so as to be pivotable against one another via the section joint 2.5. If, as shown in FIG. 11*a*, the guide element 14 is in the lowermost position, the second Bowden cable section 4.2 is tensioned and the upper section 2.3 and the lower section 2.4 lie coaxially. If the guide element 14 in FIG. 11*b* is in the uppermost position in the bearing device 14, the second Bowden cable section 4.2 is relaxed and the upper section 2.3 and the lower section 2.4 fold against one another. Conversely, the unfolding of the upper section 2.3 with respect to the lower section 2.4 is brought about by tensioning the second Bowden cable section 4.2. In FIG. 12, a protective cover 22 is provided which covers the elastic element 11. In addition, retaining elements 22.2, which are formed as buttons, are attached to the protective cover 22. Retaining means 22.1 are provided on the bracing strut 5, which is rounded in this case and constitutes a circular arc. The retaining means 22.1 are formed as button holes. Retaining means 22.1 are also provided on the jumping bed and are concealed here below the protective cover 22.

Figure 13:
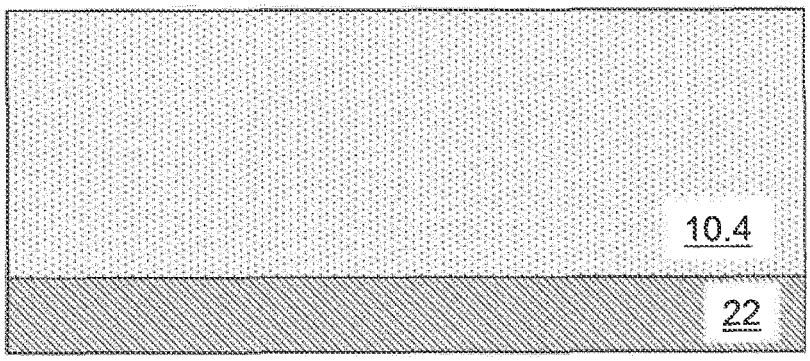
FIG. 13 shows a front view of a safety net with a protective cover.

The protective cover 22 is fastened to the safety net 10.4 in FIG. 13.

Figure 14:
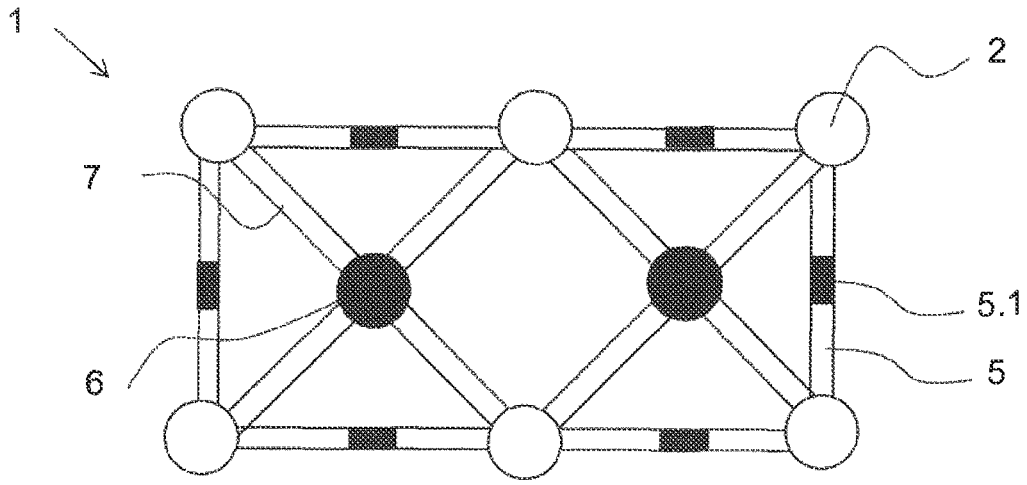
FIG. 14 shows a plan view of an exemplary embodiment of a rectangular trampoline with two central joints.

FIG. 14 shows a further exemplary embodiment of the foldable trampoline 1 with two central joints 6.

Figure 15A:
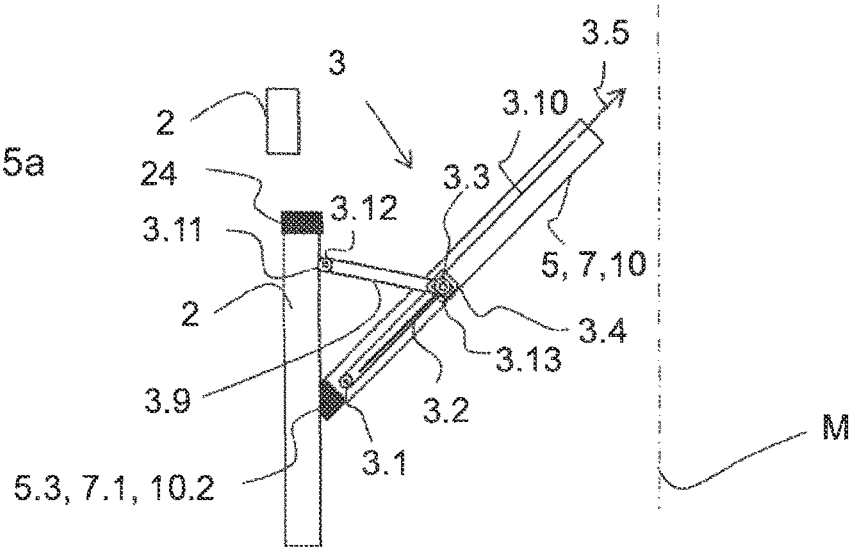
FIG. 15*a* shows a section through a bracing strut on a post with an embodiment of the first Bowden cable system in the at least partially folded state.

FIG. 15*a* shows a further development of the first Bowden cable system 3. This has an outer joint 3.11 with a pivot axis 3.12, which is provided on at least one post 2. An angled pole 3.9 is pivotably mounted via the outer joint 3.11 on the bracing strut 5 by means of a guide joint 3.3 with a pivot axis 3.13. The pivot axes 3.12, 3.13 are parallel to one another and each orthogonal to the angled pole 3.9. The guide joint 3.3 is provided within the bracing strut 5 and placed on a guide 3.2. The guide joint 3.3 can be moved on the guide 3.2 towards the post 2 or away from the post 2. The Bowden cable system 3 also has a Bowden cable 3.10. The Bowden cable 3.10 is also provided within the bracing strut 5 and initially engages the guide joint 3.3. From there, the Bowden cable 3.10 is guided via a deflection element 3.1, designed as a deflection wheel, which is disposed in the vicinity of the post 2. There, the Bowden cable 3.10 is deflected and runs further away from the post 2 to the central axis M.

Figure 15B:
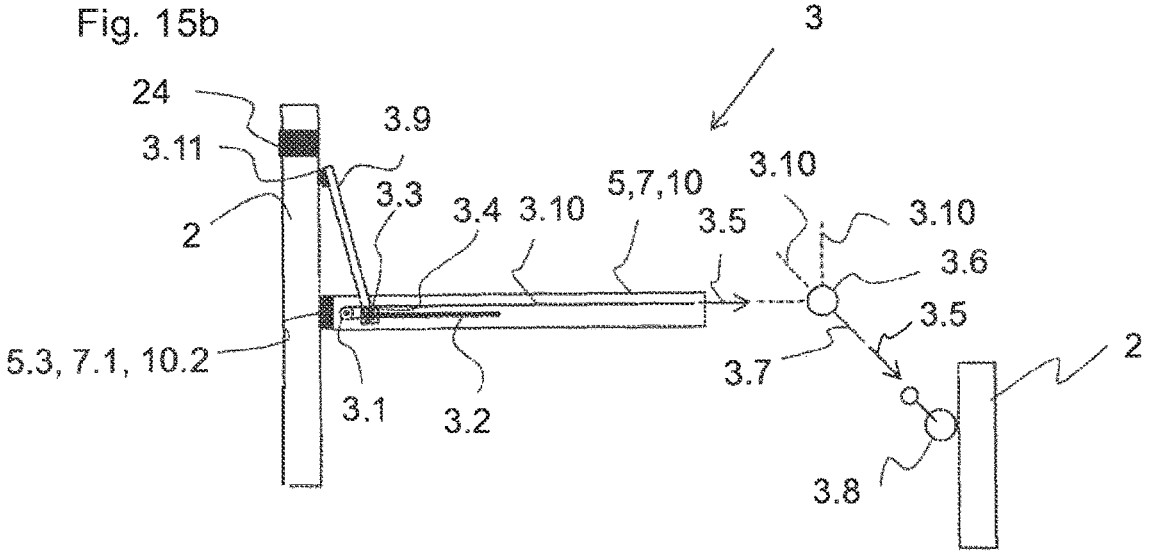
FIG. 15*b* shows a section through a bracing strut on a post with the embodiment of the first Bowden cable system in the unfolded state.

In FIG. 15*a*, the trampoline 1 is folded as far as possible. By pulling the Bowden cable 3.10 in the pull direction 3.5, the trampoline 1 is unfolded and, in the unfolded state, is stabilized by pulling on the Bowden cable 3.10 so that the trampoline 1 is stable. For unfolding, the guide joint 3.3 is moved along the guide 3.2 by means of the pull on the Bowden cable 3.10, such that it comes closer to the post 2. This leads to the angled pole 3.9 pivoting in the direction of the post 2 and thus pressing the bracing strut 5 downward. FIG. 15*b* shows the trampoline 1 at the end of the unfolding movement in the unfolded state.

In addition, a securing system 3.4 is provided, i.e. a bolt, a pin or a latching system, by means of which the guide joint 3.3 can be fixed on the guide 3.2, in particular in the unfolded state of the trampoline 1, so that a movement of the guide joint 3.3 on the guide 3.2 is no longer possible. In this way, the trampoline 1 is additionally secured, since an undesired pivoting of the bracing strut 5, in particular a folding, is prevented.

A corresponding further development of the first Bowden cable system 3 can be provided in each of the bracing struts 5. In FIG. 15*b*, the corresponding Bowden cables 3.10 are shown in simplified form by means of the dashed lines. The Bowden cables 3.10 are fixed to a junction device 3.6. A tension cable 3.7 extends from the junction device 3.6 and is guided to a tensioning crank 3.8. A corresponding pull by means of the tensioning crank 3.8 tensions the individual Bowden cables 3.10 together accordingly. The tensioning crank 3.8 can be attached to a post 2.

Alternatively, this further development can also be configured on a pole 7 or a plurality of poles 7. Accordingly, the further development can also be configured on a securing rod 10.

As an independent aspect, the post 2 has a telescopic system 24. The post 2 is in two parts in FIG. 15*a*. After unfolding, the first part of the post 2, which is the upper part in the plane of the paper, can be plugged together by means of the telescopic system 24 into the second part of the post 2, which is the lower part in the plane of the paper.

Figure 16A:
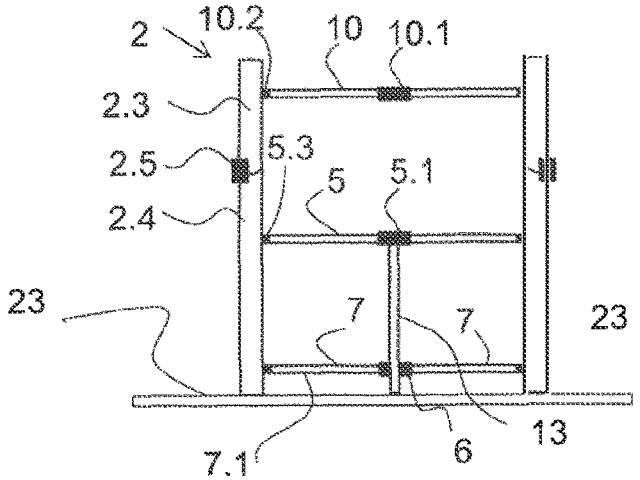
FIG. 16*a* shows an alternative embodiment of the trampoline in a front view of two posts of an unfolded trampoline.
Figure 16B:
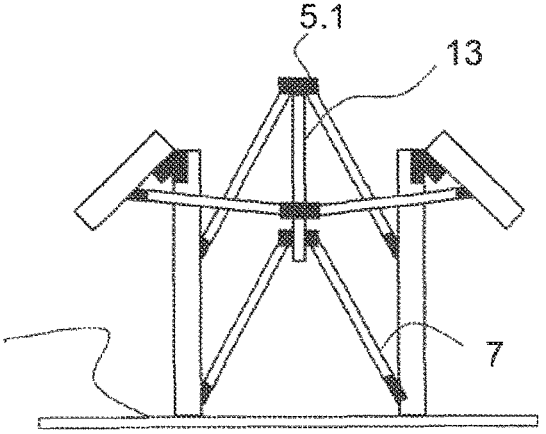
FIG. 16*b* shows an alternative embodiment of the trampoline in a front view of two posts of a folded trampoline.

FIGS. 16*a* and 16*b* correspond substantially to FIGS. 6*a* and 6*b*. In a departure from this, a joint securing means 13 is provided in the form of a foot 13. As shown in FIG. 16*a*, in the unfolded state of the trampoline 1, the foot rests on a surface 23 so that when the central joint 5.1 is loaded, for example during jumping activity, the central joint 5.1 cannot be deflected towards the surface 23. In this exemplary embodiment, the bracing struts 5 are mounted in such a way that, when the trampoline is folded together, the foot 13 lifts off the surface 23 and the corresponding pivoting movement of the bracing struts 5 is possible.

What is claimed is:

1. A foldable trampoline, comprising:

at least three posts arranged parallel to one another and to a vertical direction, wherein a jumping bed is tensioned between the at least three posts, at least three bracing struts which each connect a different pair of posts adjacent in a circumferential direction of the trampoline to one another and stabilize said posts in a horizontal direction, wherein each bracing strut is mounted so as to be foldable on the two posts adjacent in the circumferential direction and has at least one bracing strut central joint which is provided in a central region of the bracing strut, wherein all the posts adjacent in the circumferential direction is configured to each be moved toward one another in a horizontal direction in order to fold the trampoline, wherein the posts are always parallel to one another during a folding and unfolding movement of the trampoline.

2. The foldable trampoline according to claim 1, wherein at least one central joint and at least two poles are provided, wherein each pole connects a different post to the central joint and is mounted so as to be foldable both on the corresponding post and on the central joint.

3. The foldable trampoline according to claim 1, wherein the jumping bed is tensioned by at least one elastic element, wherein the elastic element is attached to at least one post and/or to at least one bracing strut.

4. The foldable trampoline according to claim 2, wherein the at least one central joint and the tensioned jumping bed have a minimum distance in the vertical direction, where the minimum distance is greater than or equal to 20, 30, 40 or 50 cm.

5. The foldable trampoline according to claim 1, wherein at least three securing rods are provided, which each connect a different pair of adjacent posts to one another and stabilize the posts in the horizontal direction, wherein each securing rod is mounted so as to be foldable on the corresponding post and has at least one securing rod central joint, which is provided in a central region of the securing rod and is used for folding the trampoline.

6. The foldable trampoline according to claim 1, wherein the post has an upper section and a lower section, wherein the upper section is arranged above the lower section in the vertical direction, wherein a section joint is provided, via which the upper section is adapted to be pivoted relative to the lower section.

7. The foldable trampoline according to claim 5, wherein a jump region for user is provided above the jumping bed in the vertical direction, wherein at least one central joint is provided below the jumping bed counter to the vertical direction and/or the securing rods are provided above the jumping bed in the vertical direction.

8. The foldable trampoline according to claim 1, wherein a separate tensioning apparatus is provided for tensioning the jumping bed, wherein the tensioning apparatus acts independently of and/or dependent on the unfolding of the trampoline.

9. The foldable trampoline according to claim 5, wherein joint securing means are provided on the bracing strut central joints and/or of the securing rod central joints in order to lock the bracing strut and/or securing rod central joints.

10. The foldable trampoline according to claim 1, wherein a tensioner, designed as a motor or a crank, is provided for operating at least a part of the folding movement and/or the unfolding movement.

11. The foldable trampoline according to claim 5, wherein a first Bowden cable system is provided, by which the unfolding of the trampoline is adapted to be operated, and/or a second Bowden cable system is provided, by which the folding of the trampoline is adapted to be operated.

12. The foldable trampoline according to claim 11, wherein the first Bowden cable system and/or the second Bowden cable system are guided at least partially within one of the posts and/or a pole and/or a securing rod.

13. The foldable trampoline according to claim 11, wherein at least one guide element is movably mounted in a bearing device within one of the posts and/or a pole and/or a securing rod, wherein the first Bowden cable system and/or the second Bowden cable system are guided via the guide element or are fixed to the guide element.

14. The foldable trampoline according to claim 11, wherein the first Bowden cable system has an angled pole between one of the posts and the bracing strut, a pole and/or a securing rod, which angled pole, during unfolding of the trampoline, exerts a force in such a way that the bracing strut, the pole and/or the securing rod moves to the position in the unfolded state.

15. The foldable trampoline according to claim 1, wherein the trampoline is adapted to be unfolded and/or folded via an exclusively translational movement of each post towards a central axis of the trampoline in each case.

16. A method for folding a foldable trampoline including structure according to claim 11, comprising the steps of: operating the second Bowden cable system and at least indirectly bring about a folding of the bracing strut central joints and/or of the securing rod central joints and/or of the poles, wherein all the posts adjacent in the circumferential direction move toward one another.

17. The method for folding a foldable trampoline according to claim 16, wherein the second Bowden cable system is operated and at least indirectly causes the upper section and the lower section of the posts of the unfolded trampoline to be pivoted from a coaxial position into a position in which they form a smallest angle of less than 180°, 90°, 45°, 20°, 10° or 5°.

18. A method for tensioning a jumping bed of a foldable trampoline according to claim 8, comprising the steps of: tensioning the jumping bed via the separate tensioning apparatus during or after the unfolding of the foldable trampoline.

* * * * *